US010605256B2

(12) United States Patent
Tyner et al.

(10) Patent No.: US 10,605,256 B2
(45) Date of Patent: Mar. 31, 2020

(54) FAN SYSTEM WITH INTEGRATED FAN-SHROUD CHANNEL FOR REDUCED RECIRCULATION FLOW

(71) Applicant: BorgWarner Inc., Auburn Hills, MI (US)

(72) Inventors: Todd Michael Tyner, Fishers, IN (US); Tobias Moser, Immenstaad (DE); Frank Michael Haase, Markdorf (DE)

(73) Assignee: BorgWarner Inc., Auburn Hills, MI (US)

( * ) Notice: Subject to any disclaimer, the term of this patent is extended or adjusted under 35 U.S.C. 154(b) by 172 days.

(21) Appl. No.: 16/015,718

(22) Filed: Jun. 22, 2018

(65) Prior Publication Data

US 2018/0372113 A1 Dec. 27, 2018

(30) Foreign Application Priority Data

Jun. 23, 2017 (DE) ..... 10 2017 210 620

(51) Int. Cl.
*F04D 29/16* (2006.01)
*F04D 29/32* (2006.01)
(Continued)

(52) U.S. Cl.
CPC ..... *F04D 29/164* (2013.01); *F04D 17/025* (2013.01); *F04D 19/002* (2013.01);
(Continued)

(58) Field of Classification Search
CPC .... F04D 29/164; F04D 29/526; F04D 29/663; F04D 29/542; F04D 29/326; F04D 25/06; F04D 25/0613; F04D 25/08; F04D 17/025; F04D 19/002
See application file for complete search history.

(56) References Cited

U.S. PATENT DOCUMENTS 4,566,852 A 1/1986 Hauser
5,282,718 A 2/1994 Koff et al.
(Continued)

FOREIGN PATENT DOCUMENTS

EP 1914402 B1 8/2011

*Primary Examiner* — Brian P Wolcott
(74) *Attorney, Agent, or Firm* — Burris Law, PLLC

(57) ABSTRACT

The invention refers to a fan system (10) comprising a fan shroud (14) and a ring fan (12) having a hub (30), a plurality of fan blades (32), and a ring structure (34). The ring structure (34) has a ring member (46) and a flange member (48), the ring member (46) having a hollow cylindrical shape, the flange member (48) extending radially outwardly from the ring member (46). The fan shroud (14) has an annular shroud flange (54), a shroud body (56) and a plurality of shroud guide vanes (58), the shroud flange (54) extending radially outwardly from the shroud body (56) and being disposed along the rotary axis (A) between the flange member (48) and the shroud body (56), the shroud body (56) being disposed about the ring member (46) and having a first body portion (70), a second body portion (72) and a divergent nozzle (74). A recirculation throttle (88) is formed by the shroud body (56) and the ring member (46) at a location where the first and second body portions (70, 72) of the shroud body (56) intersect one another. The divergent nozzle (74) and a trailing end (50) of the ring member (46) cooperate to form a dynamic sealing feature (90).

7 Claims, 4 Drawing Sheets

(51) Int. Cl.

| | |
|---|---|
| ***F04D 25/06*** | (2006.01) |
| ***F04D 29/54*** | (2006.01) |
| ***F04D 19/00*** | (2006.01) |
| ***F04D 17/02*** | (2006.01) |
| ***F04D 29/66*** | (2006.01) |
| ***F04D 29/52*** | (2006.01) |
| ***F04D 25/08*** | (2006.01) |

(52) U.S. Cl.
CPC ..... *F04D 25/06* (2013.01); *F04D 25/0613* (2013.01); *F04D 29/326* (2013.01); *F04D 29/526* (2013.01); *F04D 29/542* (2013.01); *F04D 29/663* (2013.01); *F04D 25/08* (2013.01)

(56) References Cited

U.S. PATENT DOCUMENTS

| | | | | |
|---|---|---|---|---|
| 5,489,186 | A * | 2/1996 | Yapp | F01D 5/141 415/208.3 |
| 6,599,088 | B2 | 7/2003 | Stagg | |
| 6,863,496 | B2 * | 3/2005 | Cho | F04D 29/685 415/173.5 |
| 6,874,990 | B2 * | 4/2005 | Nadeau | F04D 29/164 415/173.5 |
| 7,789,622 | B2 * | 9/2010 | Acre | F04D 29/164 415/209.3 |
| 9,909,485 | B2 * | 3/2018 | Hong | F01P 1/06 |
| 10,072,670 | B2 * | 9/2018 | Jung | F01P 11/12 |
| 10,473,116 | B2 * | 11/2019 | Stevens | F04D 29/542 |
| 2016/0305448 | A1 | 10/2016 | Hong | |

* cited by examiner

FAN SYSTEM WITH INTEGRATED FAN-SHROUD CHANNEL FOR REDUCED RECIRCULATION FLOW

CROSS-REFERENCE TO RELATED APPLICATIONS

This application claims the benefit of German Patent Application No. 102017210620.4 filed Jun. 23, 2017, the disclosure of which is herein incorporated by reference in its entirety.

FIELD

The present disclosure relates to a fan system having a ring fan and a fan shroud that provide a fan-shroud channel for reduced recirculation flow.

SUMMARY

This section provides a general summary of the disclosure, and is not a comprehensive disclosure of its full scope or all of its features.

In one form, the present disclosure provides a fan system that includes a ring fan and a fan shroud. The ring fan has a hub, a plurality of fan blades and a ring structure. The hub is rotatable about a rotary axis. The fan blades are disposed circumferentially about the hub and have a first end, which is fixedly coupled to the hub, a second end, which is opposite the first end, a leading edge and a trailing edge. The ring structure has a ring member and a flange member. The ring member has a hollow cylindrical shape and is fixedly coupled to the second ends of the fan blades. The flange member extends radially outwardly from the ring member. The fan shroud has an annular shroud flange, a shroud body and a plurality of shroud guide vanes. The shroud flange extends radially outwardly from the shroud body and is disposed along the rotary axis between the flange member and the shroud body. The shroud body is disposed about the ring member and has a first body portion, a second body portion and a divergent nozzle. The first body portion is coupled to the shroud flange and has a first interior surface of a first diameter. The second body portion is coupled to the first body portion on a side opposite the shroud flange. The second body portion has a second interior surface proximate the first interior surface of the first body portion. The second interior surface has a second diameter that is smaller than the first diameter. The divergent nozzle is coupled to the second body portion on a side of the second body portion that is opposite the first body portion. The divergent nozzle diverges outwardly from the second body portion. The shroud guide vanes extend over the shroud flange and at least a portion of the first interior surface on the first body portion. A recirculation throttle is formed by the shroud body and the ring member at a location where the first and second body portions of the shroud body intersect one another. The divergent nozzle and a trailing end of the ring member cooperate to form a dynamic sealing feature.

Optionally, the dynamic sealing feature is configured to create a first air pressure in a space between the ring member and the second body portion that is equal to a second air pressure in a space between the flange member and the shroud flange during operation of the fan system when the ring fan is rotating relative to the fan shroud within a predetermined speed range.

Optionally, the dynamic sealing feature can be configured to minimize a pressure difference between a first air pressure in a space between the ring member and the second body portion that is equal to a second air pressure in a space between the flange member and the shroud flange during operation of the fan system when the ring fan is rotating relative to the fan shroud within a predetermined speed range.

Optionally, each of the shroud guide vanes has a first vane portion and a second vane portion. The first vane portions extend from the shroud flange in a direction toward the flange member and curve about the rotary axis. The second vane portions extending radially inwardly from the first interior surface and are straight or curve about the rotary axis to a lesser extent than that of the first vane portions.

Optionally, the ring member can extend along the rotary axis forwardly of the leading edges of the fan blades. The trailing end of the ring member is disposed forwardly of the trailing edges of the fan blades. The flange member can be coupled to an end of the ring member opposite the trailing end.

Optionally, the fan system can further include an electric motor having a stator and a rotor. The stator is coupled to the fan shroud. The rotor is coupled to the ring fan.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
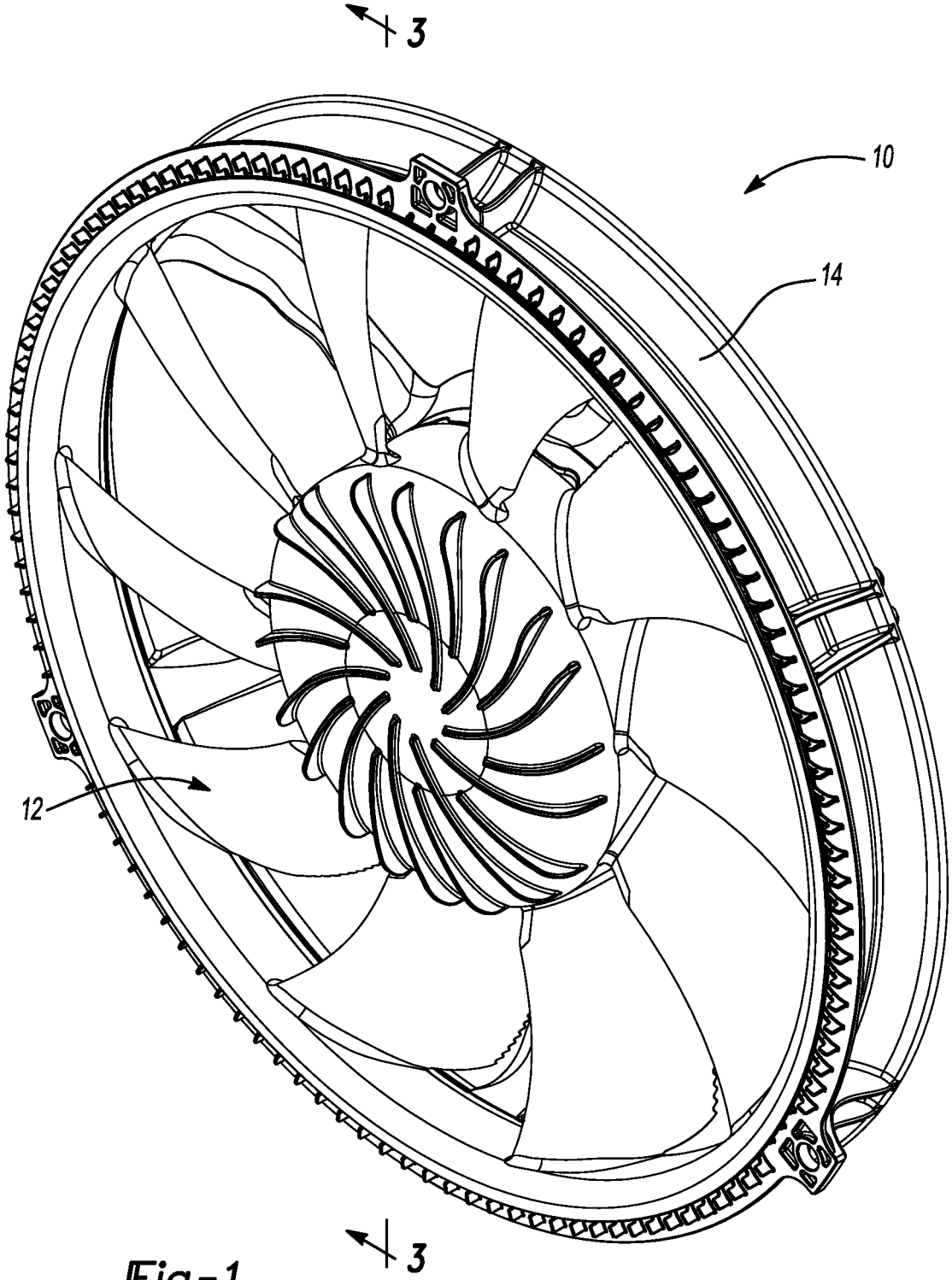
FIG. 1 is a perspective view of an exemplary fan system constructed in accordance with the teachings of the present disclosure.
Figure 2:
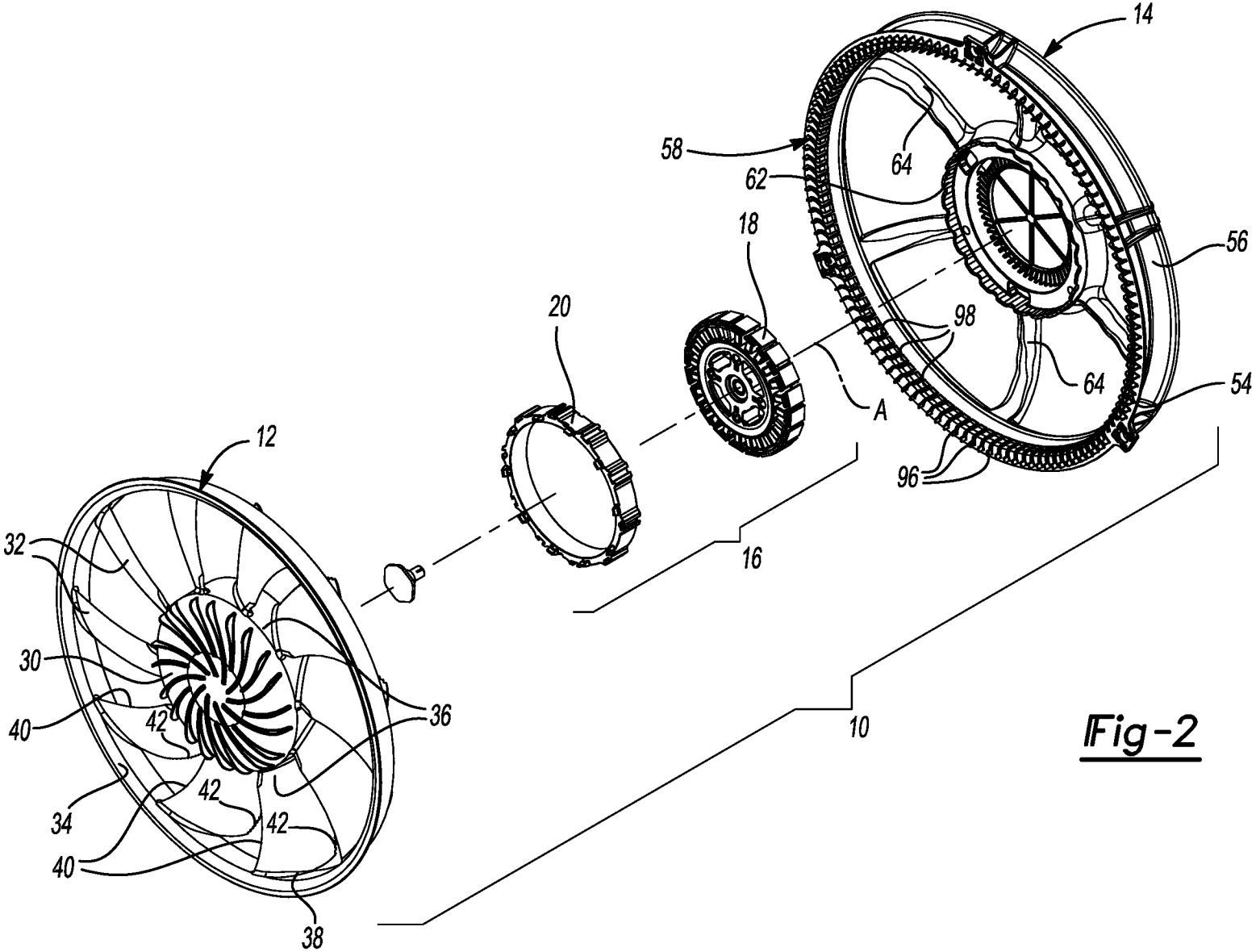
FIG. 2 is an exploded perspective view of the fan system of FIG. 1.

With reference to FIGS. 1 and 2 of the drawings, an exemplary fan system constructed in accordance with the teachings of the present disclosure is generally indicated by reference numeral 10. The fan system 10 can include a ring fan 12, a fan shroud 14 and a means for rotating the ring fan 12 relative to the fan shroud 14. In the example provided, the means for rotating the ring fan 12 relative to the fan shroud 14 comprises an electric motor 16 having a stator 18 and rotor 20, but it will be appreciated that various other structures could be employed for driving the ring fan 12 relative to the fan shroud 14, including a belt drive (not shown) of the type that is employed in a front engine accessory drive (FEAD) for an automotive vehicle. The FEAD could employ a fan clutch (not shown) for selectively decoupling the ring fan 12 from a belt-driven pulley (not shown) and/or to moderate the speed of the ring fan 12 relative to the belt-driven pulley.

With reference to FIG. 2, the ring fan 12 can have a hub 30, a plurality of fan blades 32 and a ring structure 34. The hub 30 can be rotatable about a rotary axis A and can optionally house the rotor 20 of the electric motor 16. The fan blades 32 can be disposed circumferentially about the hub 30 and can have a first end 36, which is fixedly coupled to the hub 30, a second end 38, which is opposite the first end 36, a leading edge 40 and a trailing edge 42.

Figure 3:
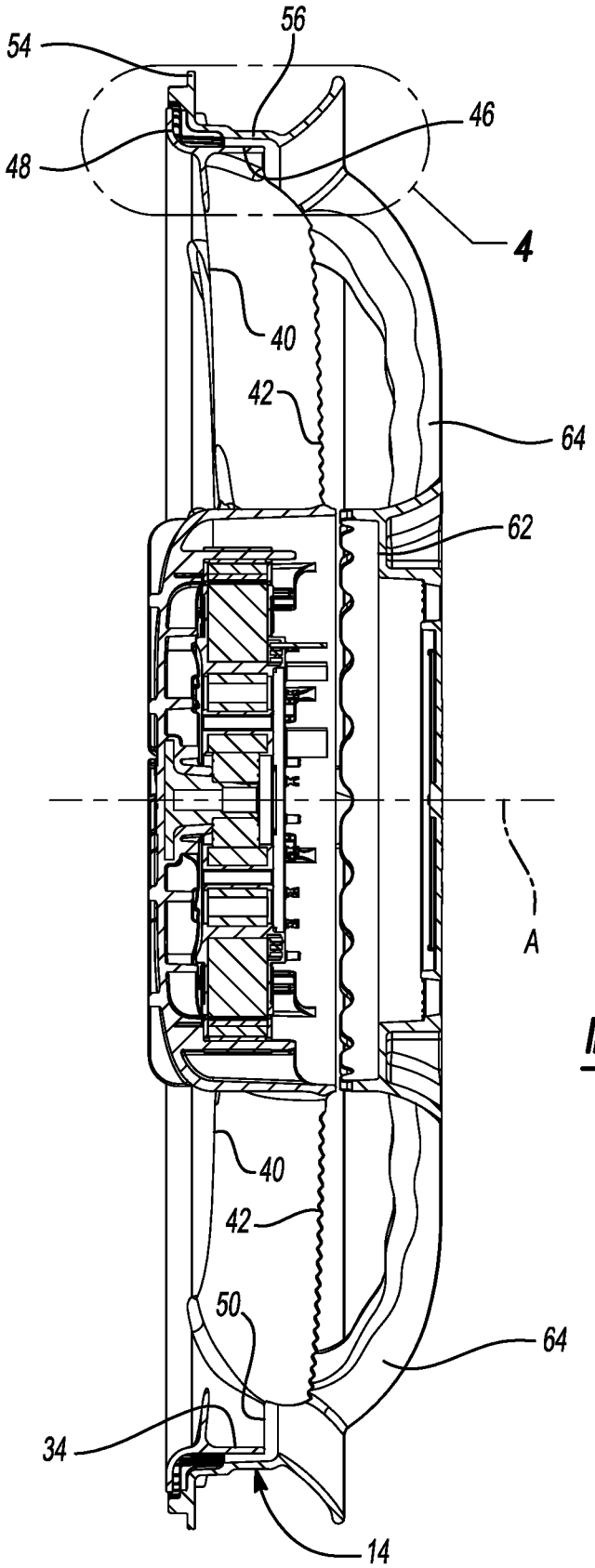
FIG. 3 is a section view taken along the line 3-3 of FIG. 1
Figure 4:
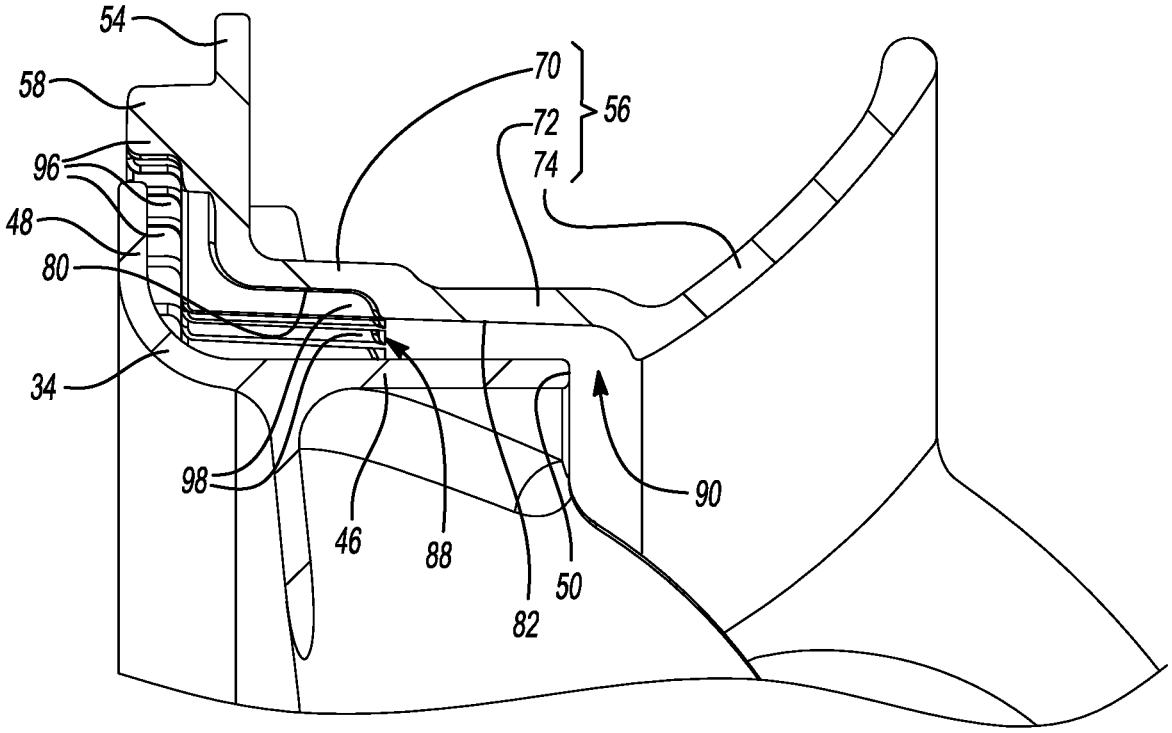
FIG. 4 is an enlarged portion of FIG. 3.

With reference to FIGS. 3 and 4, the ring structure 34 can have a ring member 46 and a flange member 48. The ring member 46 can have a hollow cylindrical shape and can be fixedly coupled to the second end 38 of the fan blades 32. In particular, the radially inner and outer surfaces defining the ring member 46 can have a straight shape and are not defined by curved profiles (except the portions where the fan blades 32 transition into the ring structure 34). The ring member can extend along the rotary axis A forwardly of the leading edges 40 of the fan blades 32. The ring member 46 has a trailing end 50 that is disposed along the rotary axis A forwardly of the trailing edges 42 of the fan blades 32. The flange member 48 can be coupled to an end of the ring member 46 that is opposite the trailing end 50. The flange member 48 can extend radially outwardly from the ring member 46. The transition between the ring member 46 and the flange member 48 can be curved. The ring structure 34 can be an integral element comprising the ring member 46 and the flange member 48.

The fan shroud 14 can have an annular shroud flange 54, a shroud body 56, a plurality of shroud guide vanes 58, a stator mount 62 and a plurality of shroud struts 64. The shroud flange 54 can extend radially outwardly from the shroud body 56 and can be disposed along the rotary axis A between the flange member 48 and the shroud body 56. The shroud flange 54 can extend further radially outward than the ring member 46.

The shroud body 56 can be disposed about the ring member 46 and can have a first body portion 70, a second body portion 72 and a divergent nozzle 74. The first body portion 70 can be coupled to the shroud flange 54 and can have a first interior surface 80 of a first diameter. The second body portion 72 can be coupled to an axial end of the first body portion 70 on a side opposite the shroud flange 54. The second body portion 72 can have a second interior surface 82 that is located proximate the first interior surface 80 of the first body portion 70. The second interior surface 82 can be formed with a second diameter that is smaller than the first diameter. A recirculation throttle 88 is formed by the shroud body 56 and the ring member 46 at a location where the first and second body portions 70 and 72 of the shroud body 56 intersect one another. The divergent nozzle 74 can be a generally frusto-conically shaped structure that can be coupled to the second body portion 72 on a side or axial end of the second body portion 72 that is opposite the first body portion 70. The divergent nozzle 74 can diverge outwardly from the second body portion 72. The divergent nozzle 74 and the trailing end 50 of the ring member 46 cooperate to form a dynamic sealing feature 90 in which the end of the divergent nozzle 74 abutting the second body portion 72 is disposed relatively closely to the trailing end 50 of the ring member 46.

The shroud guide vanes 58 can extend over the shroud flange 54 and at least a portion of the first interior surface 80 on the first body portion 70. In the example provided, each of the shroud guide vanes 58 has a first vane portion 96 and a second vane portion 98. The first vane portions 96 extend from the shroud flange 54 in an axial direction toward the flange member 48 and curve about the rotary axis A. The second vane portions 98 extend radially inwardly from the first interior surface 80 and can be straight or can curve about the rotary axis A to a lesser extent than that of the first vane portions 96.

The stator mount 62 is configured to receive the stator 18 of the electric motor 16 therein. The stator 18 can be fixedly coupled to the stator mount 62. Each of the shroud struts 64 can extend radially between the shroud body 56 and the stator mount 62.

Figure 5:
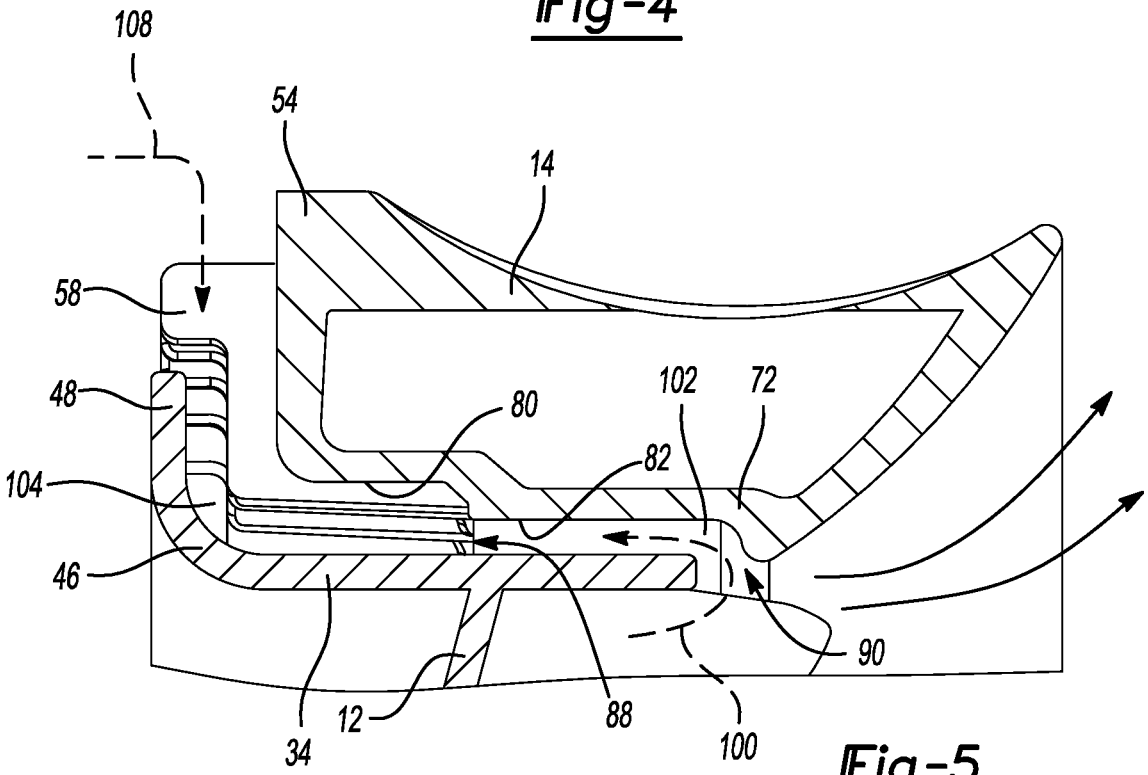
FIG. 5 is a portion of a cross-sectional view of the fan system of FIG. 1 depicting the fan system in operation so as to generate a recirculation air flow.

With reference to FIGS. 2 and 5, rotation of the ring fan 12 relative to the fan shroud 14 within a predetermined speed range during operation of the fan system 10 tends to generate a recirculation air flow 100 in the channel defined between the fan shroud 54 and the ring structure 34. The dynamic sealing feature 90, which is a narrow passage between the ring member 46 and the fan shroud 14 at a first end of the channel, can be configured to create a first air pressure in a space 102 between the ring member 46 and the second body portion 72 that is equal to a second air pressure in a space 104 between the flange member 48 and the shroud flange 54 during operation of the fan system (10) when the ring fan (12) is rotating relative to the fan shroud (14) within a predetermined speed range. The location of the dynamic sealing feature 90, along with the hollow cylindrical configuration of the ring member 46 significantly reduces a recirculation air flow 100 that flows in the channel between the ring structure 34 and the fan shroud 14 in a direction from the first end of the channel to a second end of the channel defined between the flange member 48 and the shroud flange 54/the guide vanes 58 respectively. In other words, the reduction of the recirculation air flow 100 is achieved as the dynamic sealing feature 90 controls the pressure between the first end and the second end of the channel to minimize the pressure difference between the first end and the second end of the channel. The recirculation air flow 100 is opposite a main air flow 108 that enters the air fan 12 at the second end side of the channel and exits the ring fan 12 along the divergent nozzle 74 (see FIG. 5).

Additionally, the recirculation throttle 88 and the shroud guide vanes 58 can further assist to reduce the recirculation air flow 100. The recirculation throttle 88 sets up two distinct areas having differing cross-sectional areas: a first, larger cross-sectional area defined by (extending between) the first interior surface 80 and the ring member 46, and a second, smaller cross-sectional area defined by (extending between) the second interior surface 82 and the ring member 46. The recirculation throttle 88 reduces the recirculation air flow 100 as it travels toward the space 104 between the flange member 48 and the shroud flange 54 by pressure loss due to separation at the recirculation throttle 88. The swirling flow direction of the portion of the recirculation air flow 100 reaching the second vane portions 98 is de-swirled by the second vane portions 98. Finally, the remaining recirculation air flow 100 is smoothly redirected radially outward by the first vane portions 96 of the shroud guide vanes 58 which further controls static pressure within the channel and reduces shear losses as it combines the recirculation air flow with the main air flow 108 back into the ring fan 12. In other words, the shroud guide vanes 58 can be configured to reduce a tangential component of the recirculation air flow 100 and to redirect the recirculation air flow 100 in a radial outward direction. The redirected recirculation air flow 100 is then counteracted or opposed by the main air flow 108 entering a space between the flange member 48 and the shroud flange 54. Thereby, and depending on the operating point of the fan, the recirculation air flow 100 is further reduced or completely eliminated by the main air flow 108.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fan system (10) comprising:

a ring fan (12) having a hub (30), a plurality of fan blades (32) and a ring structure (34), the hub (30) being rotatable about a rotary axis (A), the plurality of fan blades each (32) being disposed circumferentially about the hub (30) and having a first end (36), which is fixedly coupled to the hub (30), a second end (38), which is opposite the first end (36), a leading edge (40) and a trailing edge (42), the ring structure (34) having a ring member (46) and a flange member (48), the ring member (46) having a hollow cylindrical shape and being fixedly coupled to the second ends (38) each of the plurality of fan blades (32), the flange member (48) extending radially outwardly from the ring member (46); and a fan shroud (14) having an annular shroud flange (54), a shroud body (56) and a plurality of shroud guide vanes (58), the annular shroud flange (54) extending radially outwardly from the shroud body (56) and being disposed along the rotary axis (A) between the flange member (48) and the shroud body (56), the shroud body (56) being disposed about the ring member (46) and having a first body portion (70), a second body portion (72) and a divergent nozzle (74), the first body portion (70) being coupled to the shroud flange (54) and having a first interior surface (80) of a first diameter, the second body portion (72) being coupled to the first body portion (70) on a side opposite the shroud flange (54), the second body portion (72) having a second interior surface (82) proximate the first interior surface (80) of the first body portion (70), the second interior surface (82) having a second diameter that is smaller than the first diameter, the divergent nozzle (74) being coupled to the second body portion (72) on a side of the second body portion (72) that is opposite the first body portion (70), the divergent nozzle (74) diverging outwardly from the second body portion (72), each of the plurality of shroud guide vanes (58) extending over the shroud flange (54) and at least a portion of the first interior surface (80) on the first body portion (70);

wherein a recirculation throttle (88) is formed by the shroud body (56) and the ring member (46) at a location where the first and second body portions (70, 72) of the shroud body (56) intersect one another; and wherein the divergent nozzle (74) and a trailing end (50) of the ring member (46) cooperate to form a dynamic sealing feature (90).

2. The fan system (10) of claim 1, wherein the dynamic sealing feature (90) is configured to create a first air pressure in a space (102) between the ring member (46) and the second body portion (72) that is equal to a second air pressure in a space (104) between the flange member (48) and the shroud flange (54) during operation of the fan system (10) when the ring fan (12) is rotating relative to the fan shroud (14) within a predetermined speed range.

3. The fan system (10) of claim 1, wherein the dynamic sealing feature (90) is configured to minimize a pressure difference between a first air pressure in a space (102) between the ring member (46) and the second body portion (72) that is equal to a second air pressure in a space (104) between the flange member (48) and the shroud flange (54) during operation of the fan system (10) when the ring fan (12) is rotating relative to the fan shroud (14) within a predetermined speed range.

4. The fan system (10) of claim 1, wherein each of the plurality of shroud guide vanes (58) have a first vane portion (96) and a second vane portion (98), the first vane portions (96) extending from the shroud flange (54) in a direction toward the flange member (48) and curving about the rotary axis (A), the second vane portions (98) extending radially inwardly from the first interior surface (80) and being straight or curving about the rotary axis (A) to a lesser extent than that of the first vane portions (96).

5. The fan system (10) of claim 1, wherein the ring member (46) extends along the rotary axis (A) forwardly of the leading edges (40) of the plurality of fan blades (32).

6. The fan system (10) of claim 1, wherein the trailing end (50) of the ring member (46) is disposed forwardly of the trailing edges (42) of the plurality of fan blades (32).

7. The fan system (10) of claim 1, further comprising an electric motor (16) having a stator (18) and a rotor (20), the stator (18) being coupled to the fan shroud (14), the rotor (20) being coupled to ring fan (12).

* * * * *